US007070402B2

(12) United States Patent
Ai et al.

(10) Patent No.: US 7,070,402 B2
(45) Date of Patent: Jul. 4, 2006

(54) INTEGRATED SPEED REDUCER AND PUMP ASSEMBLY

(75) Inventors: Xiaolan Ai, Massillon, OH (US); Geoffrey Bishop, Hartville, OH (US)

(73) Assignee: The Timken Company, Canton, OH (US)

( * ) Notice: Subject to any disclaimer, the term of this patent is extended or adjusted under 35 U.S.C. 154(b) by 174 days.

(21) Appl. No.: 10/682,233

(22) Filed: Oct. 9, 2003

(65) Prior Publication Data

US 2004/0071559 A1 Apr. 15, 2004

Related U.S. Application Data

(60) Provisional application No. 60/417,340, filed on Oct. 9, 2002.

(51) Int. Cl.
*F03C 2/00* (2006.01)
*F16H 57/08* (2006.01)

(52) U.S. Cl. ..... 418/61.3; 418/61.1; 418/27; 418/36; 417/410.4; 475/334; 475/335

(58) Field of Classification Search ..... 418/61.3, 418/61.1, 171, 166, 27, 36, 37; 417/410.4; 475/334, 335
See application file for complete search history.

(56) References Cited

U.S. PATENT DOCUMENTS

| | | | | | |
|---|---|---|---|---|---|
| 2,066,952 | A * | 1/1937 | Hilding | ..... | 475/299 |
| 3,115,791 | A * | 12/1963 | Payne | ..... | 475/269 |
| 3,320,828 | A * | 5/1967 | Grant | ..... | 475/175 |
| 4,228,698 | A * | 10/1980 | Winiasz | ..... | 475/178 |
| 4,286,480 | A * | 9/1981 | Dickie | ..... | 475/269 |
| 4,549,449 | A * | 10/1985 | Miller et al. | ..... | 475/138 |
| 6,672,267 | B1 * | 1/2004 | Souki et al. | ..... | 123/179.3 |

FOREIGN PATENT DOCUMENTS

| | | |
|---|---|---|
| GB | 7 517484 | 6/1956 |
| GB | 2 134227 | 8/1984 |
| JP | 02 129414 | 5/1990 |
| JP | 08 334151 | 12/1996 |
| JP | 2001 289315 | 2/2001 |

* cited by examiner

*Primary Examiner*—Theresa Trieu
(74) *Attorney, Agent, or Firm*—Polster, Lieder, Woodruff & Lucchesi, L.C.

(57) ABSTRACT

An integrated speed reducer and gerotor pump is disclosed. The device comprises a motor, a speed reducer, and a gerotor pump. The motor provides torque at an elevated speed. The speed reducer is coupled with the motor and converts the torque at an elevated speed into torque at a reduced speed. The gerotor pump is coupled with the speed reducer and uses the torque at the reduced speed for pumping fluids.

13 Claims, 6 Drawing Sheets

INTEGRATED SPEED REDUCER AND PUMP ASSEMBLY

CROSS-REFERENCE TO RELATED APPLICATIONS

This application is related to U.S. Provisional Patent Application No. 60/417,340 filed, Oct. 9, 2002, from which priority is claimed.

BACKGROUND OF THE INVENTION

1. Field of the Invention

The invention relates to a speed reduction unit and a pump, in general, and, in particular, to an integrated speed reducer and pump assembly.

2. Description of Related Art

Oil pumps are widely used in vehicles of all types to provide pressurized oil flow for lubrication or for hydraulic actuation. Conventional oil pumps for vehicles are connected directly or indirectly through gears, chains or belts to the main shafts of engines for such vehicles. The rotational speeds of these pumps are in direct proportion to the engine speeds. Therefore, as engine speed increases under demanded power, the speed of a pump also increases, causing output oil pressure of the pump to increase. At higher engine speeds, the oil pressure may increase to undesirable levels. To overcome this situation, pressure relief valves are often provided in pump systems to relieve the pressure and direct the excess oil back to the pumps. However, energy is lost in this process. Thus, disconnecting an oil pump from the main drive shaft of an engine is highly desirable.

An attractive means to provide an independently powered oil pump is to electrify the pump, driving the pump independently with an electric motor. There are many advantages using electrified oil pump. For example, in an engine oil pump application an electric pump can provide lubricant to vital parts prior to engine start and/or after engine shutdown, thus extending engine life. In addition, it can adaptively regulate lubricant flow to suit various operating conditions and, as a result, improve engine performance.

However, to provide adequate power level to drive an oil pump, an electric motor usually has to run at elevated speeds to conserve motor size. Consequently, a separate speed reduction unit connecting the oil pump and electric motor is often necessary, acting as a torque multiplier. Unfortunately, the addition of a speed reduction unit requires additional space. Therefore, there is a need to integrate a speed reducer with an oil pump.

DESCRIPTION OF THE DRAWINGS

Corresponding reference characters indicate corresponding parts throughout the several views of the drawings.

DETAILED DESCRIPTION OF THE INVENTION

Figure 1:
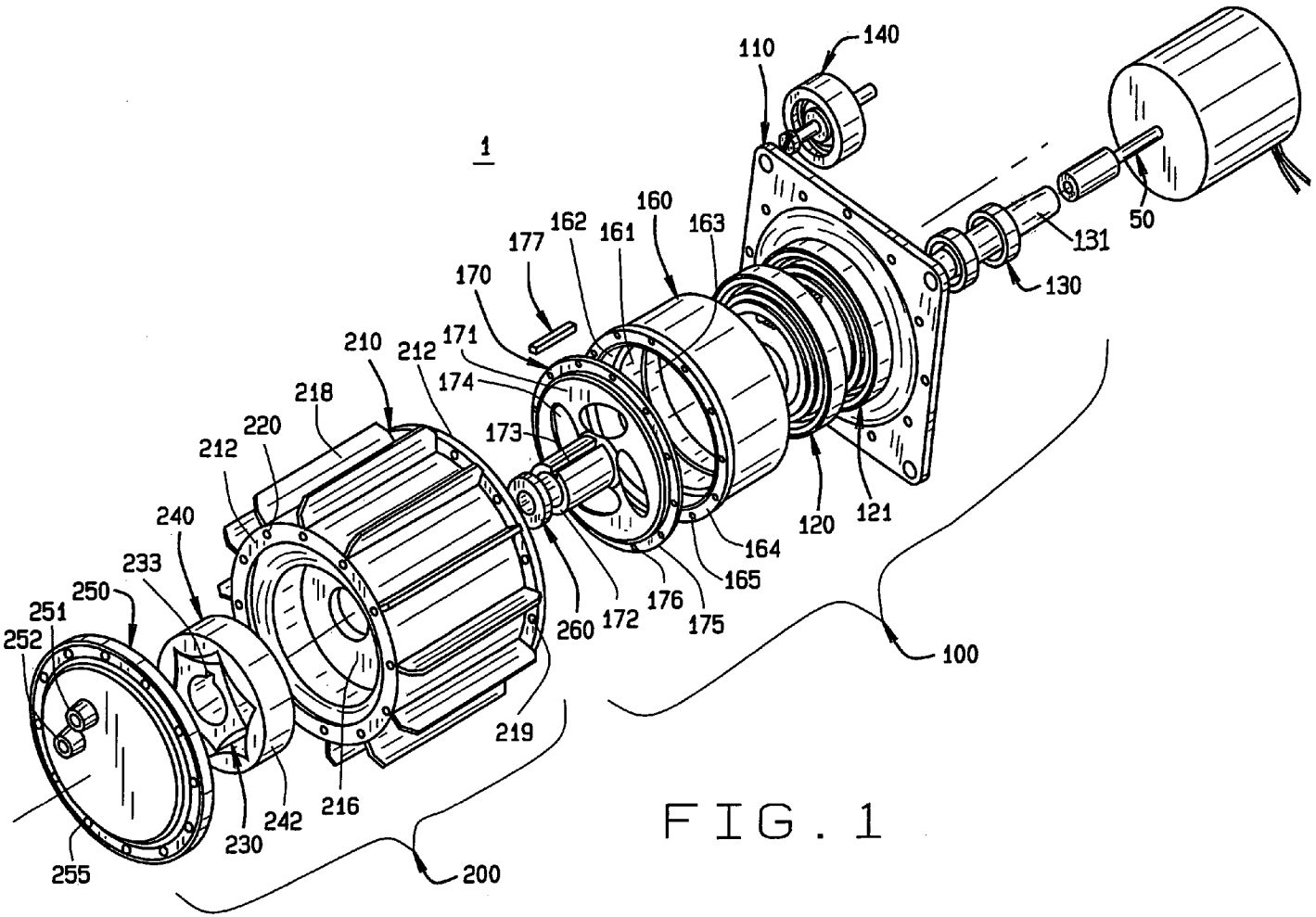
FIG. 1 is an exploded perspective view showing the front of the preferred embodiment.

Referring to FIG. 1, a preferred embodiment of the integrated speed reducer and pump assembly 1 includes an electric motor 50, a speed reducer 100, and a gerotor pump 200. The speed reducer 100 includes a carrier 110, a sun roller assembly 130, a planet assembly 140, an outer ring 160, and an output plate shaft 170.

Figure 4:
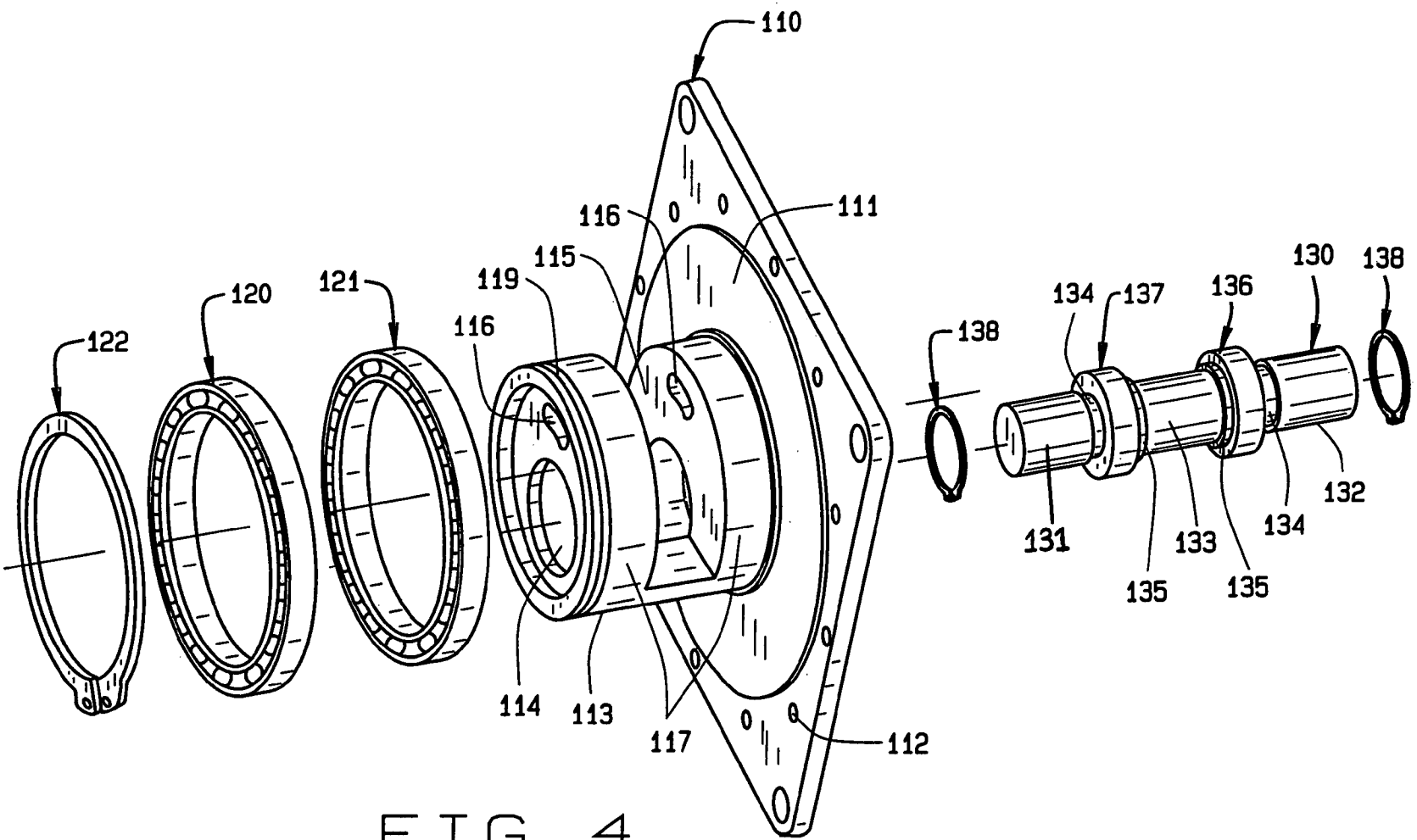
FIG. 4 is an exploded perspective view showing the carrier and sun roller assembly.

As shown in FIG. 4, the carrier 110 includes a rectangular plate 111, a spindle 113, two bearings 120 and 121, and mounting holes 112. The spindle 113 extends perpendicularly from the center of the plate 111 and defines a spindle hole 114, a spindle slot 115, and obround pin holes 116. The spindle hole 114 is an annular hole extending the length of the spindle 113 and eccentric to the center axis of the spindle 113 and the plate 111. The spindle slot 115 cuts across the spindle 113 parallel with the plate 111 exposing the spindle hole 114. In addition, the obround pin holes 116 extend the length of the spindle 113 and are offset from and parallel with the spindle hole 114. The two bearings 120 and 121 are affixed to an outer surface 117 of the spindle 113. If desired, the bearings 120 and 121 may be additionally secured by inserting a snap ring 122 that fits into a channel 119 of the spindle 113. While the preferred embodiment illustrates two bearings, any multitude of bearings may be used. Finally, the mounting holes 112 are positioned around the plate 111 of the carrier 110 for mounting to the gerotor pump 200.

Figure 3:
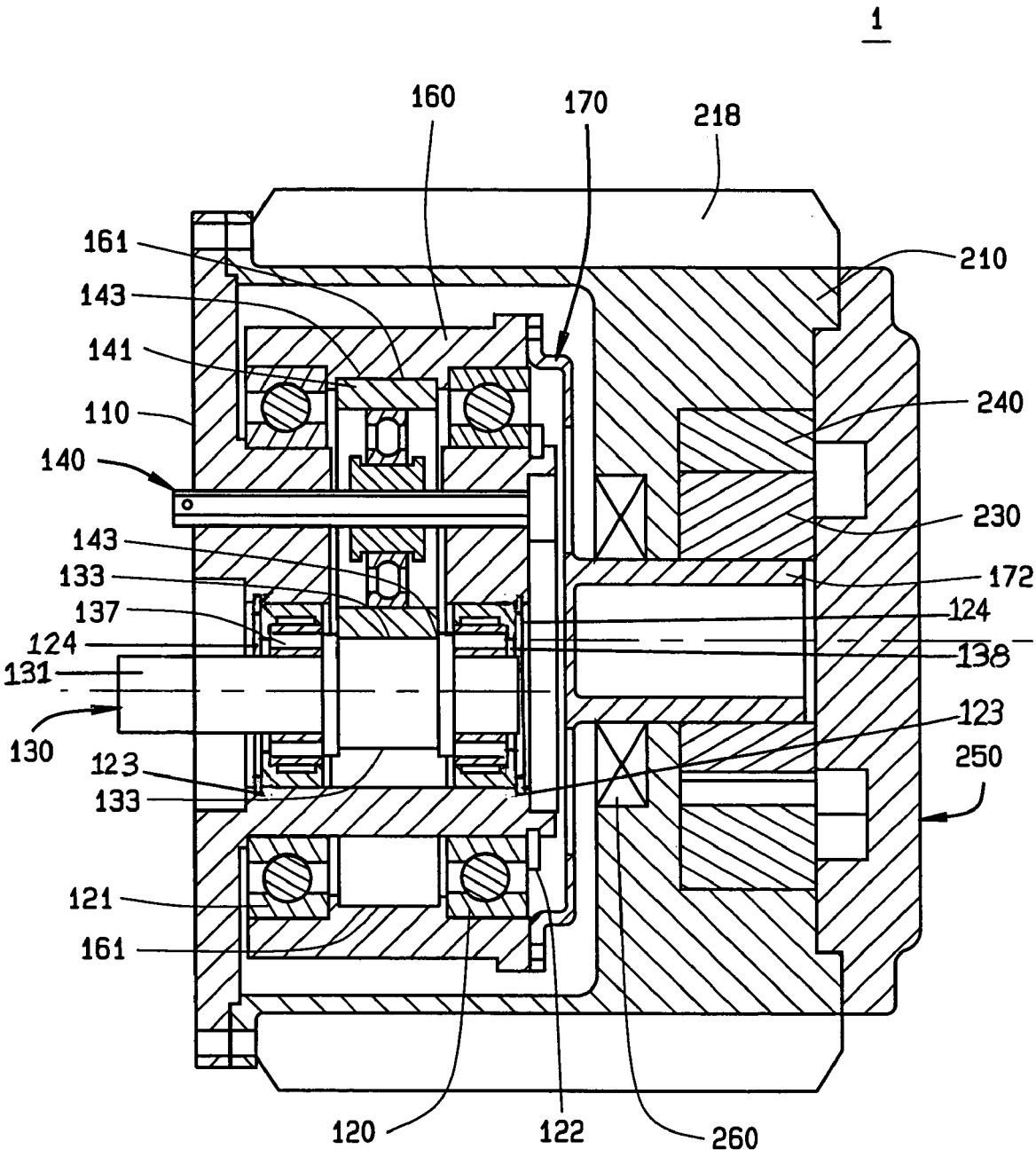
FIG. 3 is a longitudinal sectional view of the preferred embodiment.

As shown in FIG. 4, the sun roller assembly 130 includes a sun roller 131 and two bearings 136 and 137. The sun roller 131 is a shaft that includes an input end 132, a first raceway 133, channels 134 and shoulders 135. The two bearings 136 and 137 are affixed along the sun roller 131 abutting the shoulders 135, defining a first raceway 133 therebetween which rotates freely. As shown in FIG. 3, the sun roller assembly 130 resides within the spindle hole 114 of the spindle 113 so that the first raceway 133 is aligned with the spindle slot 115. Snap rings 138 lock into the channels 134 of the sun roller 131, thereby, axially fixing bearings 136 and 137 on the sun roller 131 In addition, snap rings 124 lock into channels 123 of the spindle hole 114, thereby, axially fixing the sun roller assembly 130 within the spindle hole 114. To power the sun roller assembly 130, the input end 132 couples with the electric motor 50 using any appropriate mechanical means, such as keyways, splines, or integrated with the motor rotor shaft.

Figure 5:
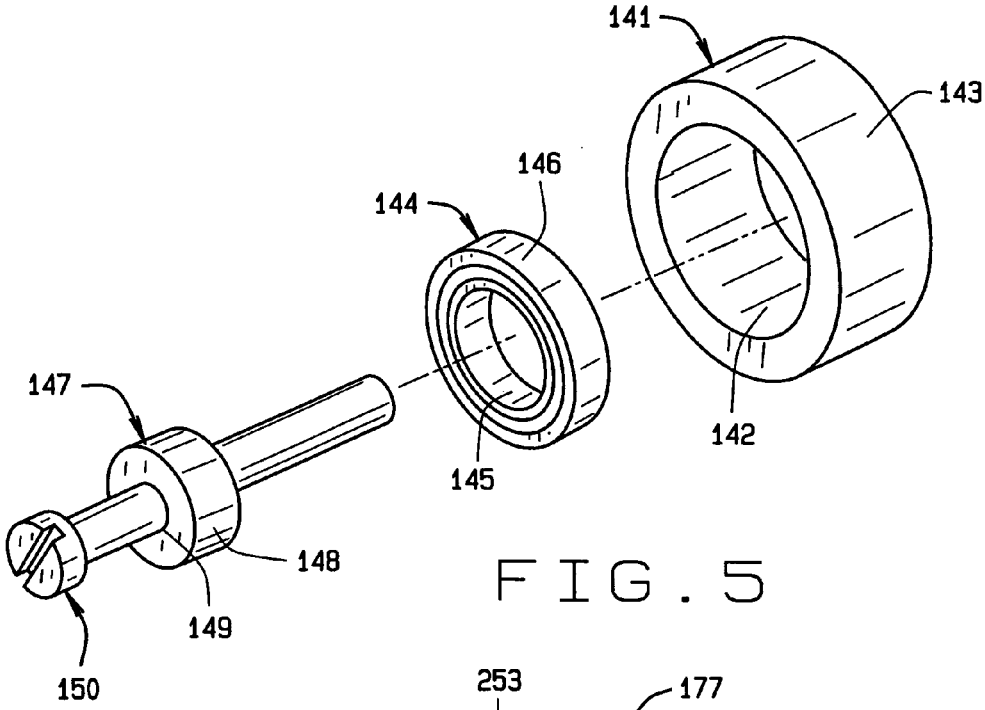
FIG. 5 is an exploded perspective view of the planet assembly.

Referring to FIG. 5, the planet assembly 140 includes a planetary roller 141, a support bearing 144, an elastic insert 147, and a pin shaft 150. The elastic insert 147 is circularly shaped with an outer surface 148 and a center hole 149. The support bearing 144 is a circular anti-friction bearing, such as a ball bearing, with an inner race 145 and an outer race 146. The planetary roller 141 is also circularly shaped with an inner surface 142 and a second raceway 143. When assembled as in FIGS. 1 and 2, the support bearing 144 attaches to the elastic insert 147 with its inner race 145 fitted tightly over the outer surface 148. Then, the planetary roller 141 is fitted to the support bearing 144 with an interference fit between its inner race 142 and the outer race 146 of the support bearing 144 so that the planetary roller 141 can rotate freely. Next, the elastic insert 147 is attached to the pin shaft 150 by inserting the pin shaft 150 through the center hole 149 of the elastic insert 147. Finally, the pin shaft 150 is inserted through the pin holes 116 in the spindle 113 so that the attached, elastic insert 147, support bearing 144, and planetary roller 141 are assembled within the spindle slot 115. The obround shape of the pin holes 116 allow the pin shaft 150 to slide back and forth slightly. During operation, this allows the planetary roller 141 to automatically shift to an effective position for the second raceway 143 of the planetary roller 141 to engage in a convergent wedge between the first raceway 133 of the sun roller 131 and a third raceway 161 of the outer ring 160 allowing torque to be transferred between the sun roller 131 and the outer ring 160.

Figure 2:
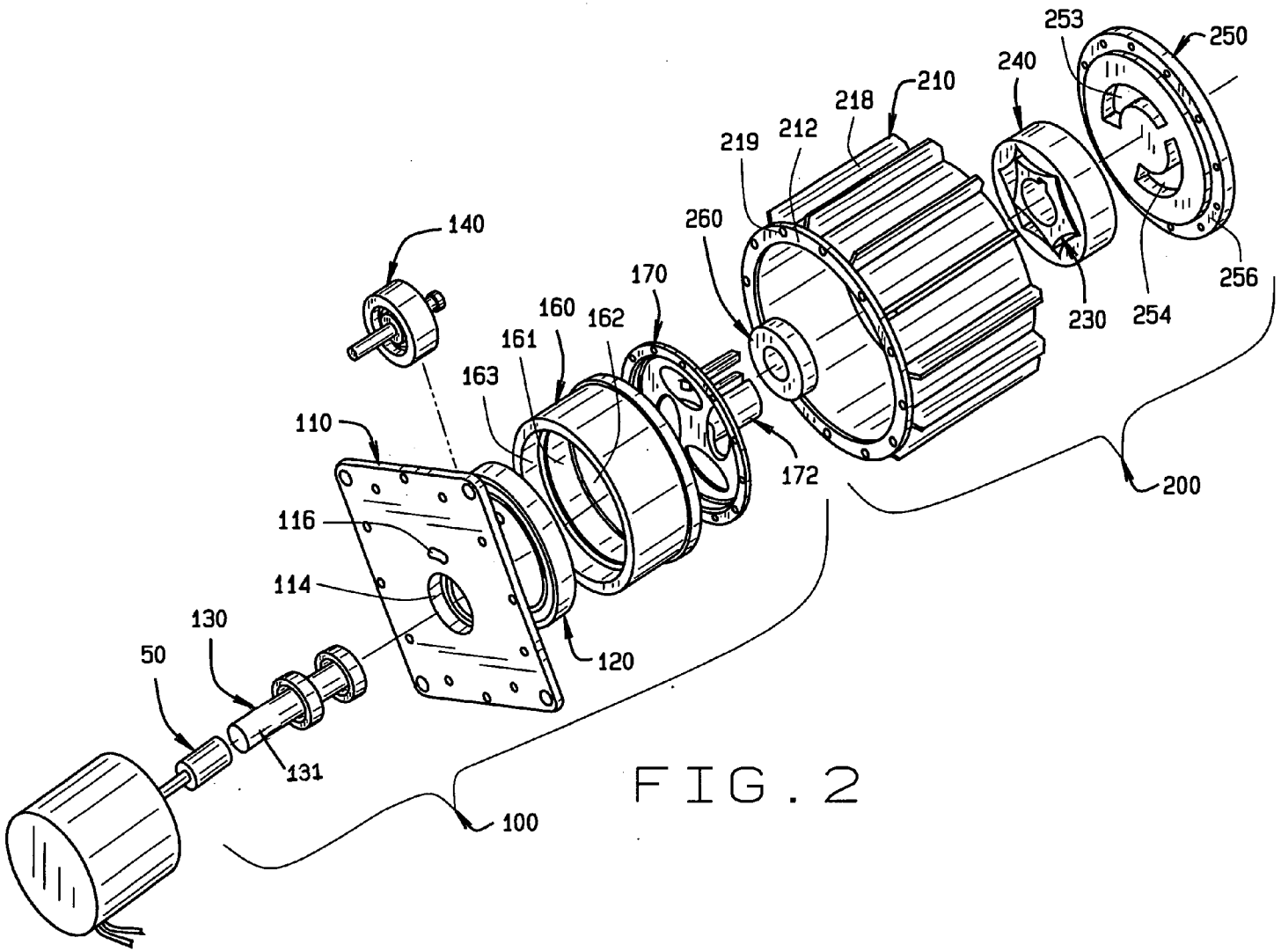
FIG. 2 is an exploded perspective view showing the back of the preferred embodiment.

As shown in FIGS. 1 and 2, the outer ring 160 is annularly shaped with a third raceway 161, two bearing seats 162 and 163, a front face 164, and mounting holes 165. The outer ring 160 engages with the carrier 110 so that the bearings 120 and 121 seat within the respective bearing seats 162 and 163. In this position, the third raceway 161 engages the second raceway 143 of the planetary roller 141 allowing torque to be transferred. The mounting holes 165 are positioned equally around the front face 164 for attachment to the output plate shaft 170.

The output plate shaft 170 includes a base plate 171, a driving shaft 172, a key slot 173, openings 174, and mounting holes 175. The mounting holes 175 are positioned around an edge portion 176 of the base plate 171. Accordingly, the base plate 171 attaches to the outer ring 160 using an appropriate mechanical means, such as bolts or rivets, by aligning the mounting holes 175 of the output plate shaft 170 to the respective mounting holes 165 of the outer ring 160. The openings 174 are equally positioned around the base plate 171 and may be any appropriate shape, such as elliptical, to encourage the circulation of traction fluid, if used, around the speed reducer 100. The driving shaft 172 extends perpendicularly from the center of the base plate 171 and includes the key slot 173 that is directed axially for coupling with the gerotor pump 200.

Figure 6A:
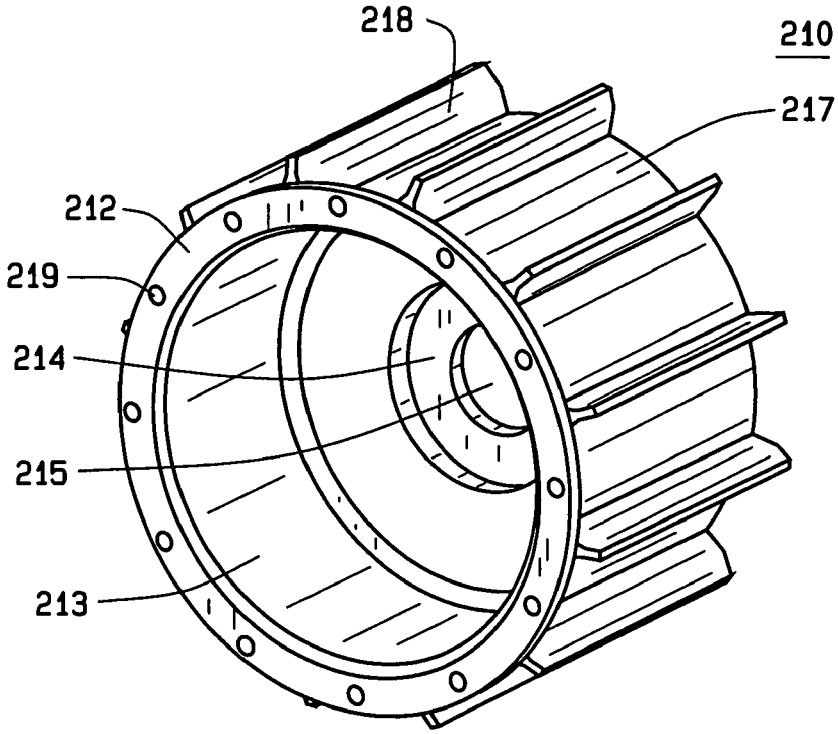
FIG. 6A is a rear perspective view of the housing.
Figure 6B:
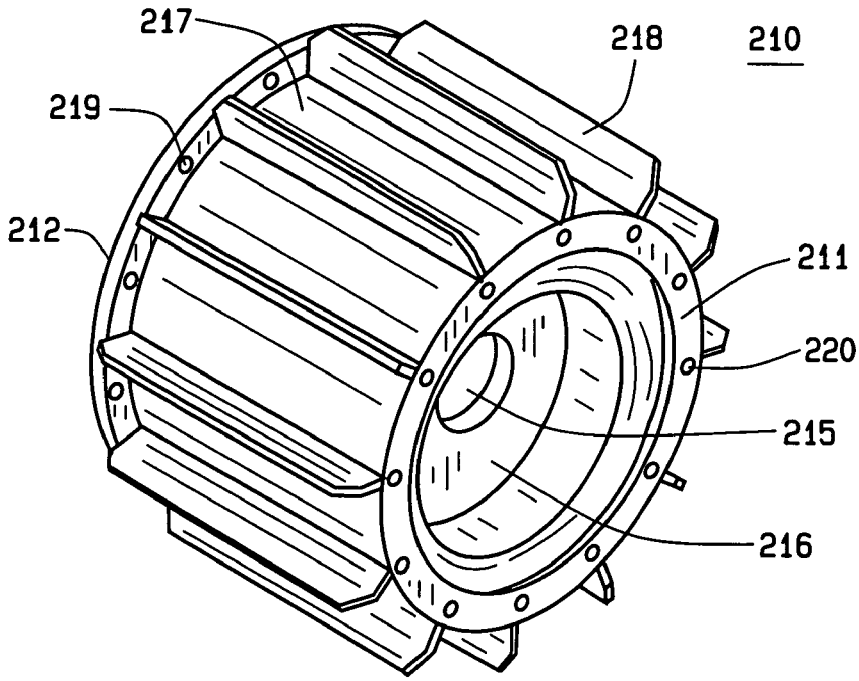
FIG. 6B is a front perspective view of the housing.

The gerotor pump 200 includes a housing 210, a bidirectional seal 260, a rotor 230, a ring gear 240, and an end cover 250. Referring to FIGS. 1–2, the speed reducer 100 and gerotor pump 200 both share a common housing 210. As shown in FIGS. 6A and 6B, the housing 210 defines a front face 211, a back face 212, a chamber 213, a recessed seat 214, a center hole 215, a gear bore 216, an outer surface 217, fins 218, a first plurality of mounting holes 219, and a second plurality of mounting holes 220. The gear bore 216 is eccentric to the center of the chamber 213. The first plurality of mounting holes 219 is equally positioned around the back face 212. Accordingly, the housing 210 attaches to the carrier 110 using an appropriate mechanical means, such as bolts or rivets, by aligning the first plurality of mounting holes 219 of the housing to the respective mounting holes 112 of the carrier 110. Thus, the back face 212 attaches to the plate 111 of the carrier 110 so that the speed reducer 100 resides completely within the chamber 213. In addition, the driving shaft 172 extends through the center hole 215 of the housing 215. If desired, the chamber 213 may be filled with traction fluid to aid the transfer of power through the raceways 133, 143, and 161 of the speed reducer 100. The bidirectional seal 260 seats against the recessed seat 214 of the housing 210 and the driving shaft 172 of the output plate shaft 170 to prevent any transfer of fluids between the speed reducer 100 and the gerotor pump 200. The fins 217 are equally spaced around the outer surface 217 of the housing 210 for the dual purpose of cooling and re-enforcement of the housing 210. The second plurality of mounting holes 220 is equally positioned around the front face 211 of the housing for mounting of the end cover 250.

Figure 7:
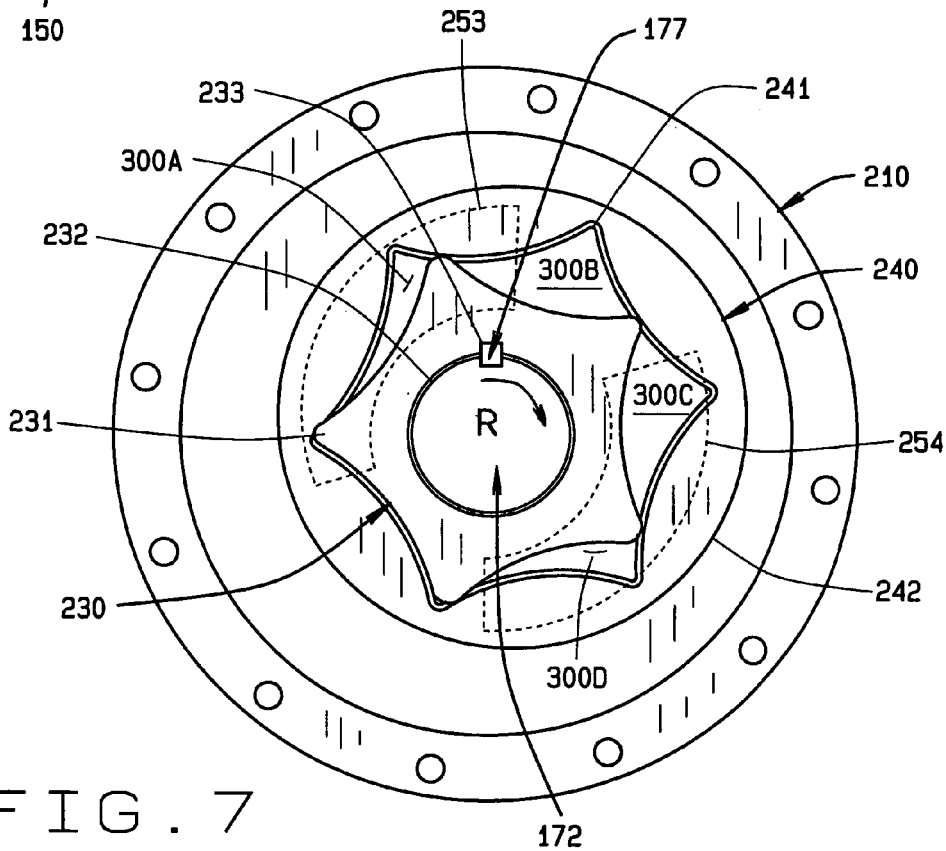
FIG. 7 is a front view of rotor engaging the ring gear.

Referring to FIG. 7, the rotor 230 and ring gear 240 are basically typical of those used in gerotor pumps. The rotor 230 includes external teeth 231, a center hole 232, and a key slot 233. The ring gear 240 includes internal teeth 241, and an outside surface 242. The rotor 230 has one less external tooth 231 than the ring gear 240 has internal teeth 241. The rotor 230 resides within the ring gear 240 so that the external teeth 231 mesh with the internal teeth 241 forming pumping chambers 300A, 300B, 300C, and 300D. The ring gear 240 seats within the gear bore 216 and the center hole 232 of the rotor 230 couples with the driving shaft 172 of the output plate shaft 170 by placing the key 173 within key slot 233 of the rotor and key slot 173 of the driving shaft 172. While the preferred embodiment discloses a key 177, those skilled in the art will recognize that the center hole 232 of the rotor 230 may be coupled with the driving shaft 172 using any appropriate mechanical means, such as a spline or coupling.

Referring to FIGS. 1 and 2, the end cover 250 includes an inlet port 251, an outlet port 252, an inlet chamber 253, an outlet chamber 254, a mounting face 255, and mounting holes 256. The mounting holes 256 are equally positioned around the mounting face 255. Accordingly, the end cover 250 attaches to the housing 210 using an appropriate mechanical means, such as bolts or rivets, by aligning the mounting holes 256 of the end cover 250 with the respective second plurality of mounting holes 220 of the housing 220. The inlet port 252 is frustum conically shaped and extends perpendicularly from the end cover 250. The inlet port 251 receives fluid from a fluid source and communicates the fluid to the inlet chamber 253. The outlet port 252 is frustum conically shaped and extends perpendicularly from the end cover 250. The outlet port 252 receives fluid from the outlet chamber 254 and discharges the fluid. The inlet chamber 253 is arcuately shaped and communicates fluid from the inlet port 252 to the pumping chambers 300A and 300B. The outlet chamber 254 is arcuately shaped and communicates fluid from the pumping chambers 300C and 300D to the outlet port 252.

In operation, the electric motor 50 supplies power in the form of torque at an elevated speed to the sun roller 131. As the sun roller 131 rotates, torque is transferred from the sun roller 131 to the planetary roller 141 to the outer ring 160 via frictional contact between the first raceway 133 and second raceway 143 and between the second raceway 143 and third raceway 161. During this transfer, the torque is converted from an elevated rotational speed at the sun roller 131 to a reduced rotational speed at the outer ring 160. As a result, the attached driving shaft 172 rotates at a reduced speed, but the torque is multiplied.

The traction forces generated at the contacts between the first raceway 133 and the second raceway 143, as well as between the second raceway 143 and the third raceway 161 push the planetary roller 141 into a converged wedge formed between the first raceway 133 and the third raceway 161. Under steady state, equilibrium is established, leading to the following relationship:

$$\frac{K_S}{K_R} = \mu_o \sin\delta - 2\sin^2\left(\frac{\delta}{2}\right)$$

where $K_S$=effective support stiffness of planetary roller $K_R$=effective contact stiffness between the planetary roller and the sun roller and between the planetary roller and the outer ring $\mu_o$=operating traction coefficient $\delta$=wedge angle between the first raceway and third raceway To prevent the speed reducer from excessive slip at the contacts, the following inequality must hold true $$\frac{K_S}{K_R} = \mu_o \sin\delta - 2\sin^2\left(\frac{\delta}{2}\right) \leq \mu_m \sin\delta - 2\sin^2\left(\frac{\delta}{2}\right)$$

where $\mu_m$=maximum available traction coefficient.

The above equation may also be expressed as $$\frac{K_S}{K_R \cdot \sin\delta} + \tan\frac{\delta}{2} \leq \mu_m$$

As shown in FIG. 7, the driving shaft 172 drives the rotor 230 at the reduced speed to rotate in the direction shown as "R". As the rotor 230 rotates, it drives the ring gear 240 to rotate within the gear bore 216 around an axis eccentric to the rotor 23. As a result, an area of lower pressure develops in the pumping chambers labeled 300A and 300B. With further rotation of rotor 230, the pumping chambers 300A and 300B decrease in volume producing areas of higher pressure as shown by the pumping chambers labeled 300C and 300D. Consequently, the fluid is pumped from the pumping chambers 300C and 300D through outlet chamber 254 and discharged through the outlet port 252.

What is claimed is:

1. An integrated speed reducer and gerotor pump assembly comprising:

a motor providing torque at an elevated speed;

a speed reducer configured for receiving torque at an elevated speed and increasing the torque to a reduced speed, a gerotor pump coupled with the speed reducer for receiving the torque at the reduced speed for pumping fluids;

a housing for hosting both the gerotor pump and the speed reducer;

the speed reducer further comprising;

a sun roller having an input end coupled with the motor and having a first raceway;

a planetary roller having a second raceway; and an outer ring having a third raceway eccentric to the first raceway so that the second raceway of the planetary roller engages frictional contacts with the first raceway of the sun roller and the third raceway of the outer ring for transferring torque between the sun roller and the outer ring.

2. An integrated speed reducer and gerotor pump assembly as described in claim 1, wherein the speed reducer comprises:

a carrier having a plate and a spindle defining a spindle bore, a spindle slot, and pin holes;

at least one bearing affixed to the spindle; and at least one bearing affixed to the sun roller and engaged with the spindle bore so that the sun roller rotates freely within the spindle bore and the first raceway is aligned with the spindle slot.

3. An integrated speed reducer and gerotor pump as described in claim 1, wherein the gerotor pump comprises:

a housing having a chamber, a recessed seat, a center hole, a gear bore eccentric to the center hole, a front face, and a back face affixed to the carrier such that the speed reducer resides within the chamber;

an end cover having a mounting face affixed to the front face of the housing, an inlet chamber, an outlet chamber, an inlet port for communicating fluid to the inlet chamber, and an outlet port for communicating fluid from the outlet chamber;

a seal seated within the recessed seat of the housing to prevent the transfer of fluids between the gerotor pump and the speed reducer;

a ring gear rotatably seated within the gear bore of the housing having a plurality of internal teeth;

a rotor having a center hole engaged with the speed reducer for receiving torque at a reduced speed thereby rotating the rotor and a plurality of external teeth which engage the internal teeth of the ring gear forming pumping chambers which communicate fluid from the inlet chamber to the outlet chamber as the rotor rotates.

4. An integrated speed reducer and gerotor pump as described in claim 1, wherein the speed reducer further comprises:

a carrier having a plate and a spindle defining a spindle bore, a spindle slot, and pin holes;

a support bearing having an outer race and an inner race, such that the outer race of the support bearing engages the planetary roller allowing the planetary roller to rotate freely;

an elastic insert having an outer surface and an center hole, such that the outer surface of the elastic insert engages the inner race of the support bearing;

a pin shaft engaged with the center hole of the elastic insert and inserted into the pin holes, such that the planetary roller, support bearing, and elastic insert are assembled within the spindle slot.

5. An integrated speed reducer and gerotor pump as described in claim 1, wherein the speed reducer further comprises:

an output plate shaft having a base plate affixed to the front face of the outer ring, and a driving shaft coupled with the gerotor pump so that the driving shaft transfers torque at a reduced speed from the outer ring to the gerotor pump.

6. An integrated speed reducer and gerotor pump as described in claim 1, wherein the gerotor pump further comprises:

a rotor having external teeth;

a ring gear eccentric to the rotor having internal teeth wherein the ring gear has more internal teeth than the rotor has external teeth.

7. An integrated speed reducer and gerotor pump assembly comprising:

a speed reducer configured to receive torque at an elevated speed and to increase the torque at a reduced speed, the speed reducer further including;

a sun roller having a first raceway;

a planetary roller having a second raceway;

an outer ring having a third raceway eccentric to the first raceway so that the second raceway of the planetary roller engages frictional contacts with the first raceway of the sun roller and the third raceway of the outer ring for transferring torque between the sun roller and outer ring;

a gerotor pump coupled with the speed reducer for receiving torque at the reduced speed for pumping fluids, the gerotor pump further including;

a housing for hosting both the gerotor pump and the speed reducer;

a rotor having external teeth;

a ring gear eccentric to the rotor having internal teeth wherein the ring gear has more internal teeth than the rotor has external teeth.

8. An integrated speed reducer and gerotor pump as described in claim 7, wherein the speed reducer further comprises:

a carrier having a plate and a spindle, the spindle defining a spindle bore, a spindle slot, and pin holes;

at least one bearing affixed to the spindle;

at least one bearing affixed to the sun roller and engaged with the spindle bore so that the sun roller rotates freely within the spindle bore and the first raceway is aligned with the spindle slot.

9. An integrated speed reducer and gerotor pump as described in claim 7, wherein the speed reducer further comprises:

a carrier having a plate and a spindle, the spindle defining a spindle bore, a spindle slot, and pin holes;

a support bearing having an outer race and an inner race, such that the outer race of the support bearing engages the planetary roller allowing the planetary roller to rotate freely;

an elastic insert having an outer surface and an center hole, such that the outer surface of the elastic insert engages the inner race of the support bearing;

a pin shaft engaged with the center hole of the elastic insert and inserted into the pin holes, such that the planetary roller, support bearing, and elastic insert are assembled within the spindle slot.

10. An integrated speed reducer and gerotor pump as described in claim 7, wherein the speed reducer further comprises:

an output plate shaft having a base plate affixed to a front face of the outer ring, and a driving shaft coupled with the gerotor pump so that the driving shaft transfers torque at a reduced speed from the outer ring to the gerotor pump.

11. An integrated speed reducer and gerotor pump as described in claim 10, further comprising traction fluid, wherein the output plate shaft further comprises openings in the base plate for circulating the traction fluid.

12. An integrated speed reducer and gerotor pump as described in claim 7, wherein the gerotor pump further comprises:

an end cover having a mounting face affixed to a front face of the housing, en inlet chamber, an outlet chamber, an inlet port for communicating fluid to the inlet chamber, and an outlet port for communicating fluid from the outlet chamber, wherein the external teeth of the rotor engage the internal teeth of the ring gear to form pumping chambers which communicate fluid from the inlet chamber to the outlet chamber as the rotor rotates.

13. An integrated speed reducer and gerotor pump as described in claim 7, wherein the gerotor pump further comprises a seal seated within a recessed seat of the housing to prevent the transfer of fluids between the gerotor pump and the speed reducer.

* * * * *

UNITED STATES PATENT AND TRADEMARK OFFICE

CERTIFICATE OF CORRECTION

PATENT NO. : 7,070,402 B2
APPLICATION NO. : 10/682233
DATED : July 4, 2006
INVENTOR(S) : Xiaolan Ai and Geoffrey Bishop It is certified that error appears in the above-identified patent and that said Letters Patent is hereby corrected as shown below:

Col. 8, Line 17, Claim 12
Replace "en"
With -- an --

Signed and Sealed this

Thirty-first Day of July, 2007

JON W. DUDAS
*Director of the United States Patent and Trademark Office*